US008960402B2

(12) United States Patent
Lee

(10) Patent No.: US 8,960,402 B2
(45) Date of Patent: Feb. 24, 2015

(54) FINANCIAL DEVICE, METHOD OF CONTROLLING THE SAME, AND MEDIUM PROCESSING APPARATUS

(75) Inventor: Sumin Lee, Seoul (KR)

(73) Assignee: LG CNS Co., Ltd., Seoul (KR)

( * ) Notice: Subject to any disclaimer, the term of this patent is extended or adjusted under 35 U.S.C. 154(b) by 14 days.

(21) Appl. No.: 13/195,967

(22) Filed: Aug. 2, 2011

(65) Prior Publication Data

US 2012/0031728 A1 Feb. 9, 2012

(30) Foreign Application Priority Data

Aug. 3, 2010 (KR) ..... 10-2010-0074830

(51) Int. Cl.
*G07F 7/04* (2006.01)
*G07F 19/00* (2006.01)

(52) U.S. Cl.
CPC ..... *G07F 19/202* (2013.01); *G07F 19/20* (2013.01); *G07F 19/203* (2013.01)
USPC ..... 194/206; 271/31.1; 271/149; 271/181; 414/790.3; 414/790.5; 414/790.8

(58) Field of Classification Search
USPC ..... 194/206, 207; 209/534; 221/242; 271/157, 158, 149, 31.1; 414/790.3, 414/790.5, 790.8
See application file for complete search history.

(56) References Cited

U.S. PATENT DOCUMENTS 5,097,959 A * 3/1992 Tilles et al. ..... 209/584
5,829,742 A * 11/1998 Rabindran et al. ..... 271/150
5,833,076 A * 11/1998 Harres et al. ..... 211/51
6,390,756 B1 * 5/2002 Isaacs et al. ..... 414/281
6,398,000 B1 * 6/2002 Jenrick et al. ..... 194/200
6,460,705 B1 10/2002 Hallowell
7,913,830 B2 * 3/2011 Lee et al. ..... 194/206
7,938,245 B2 * 5/2011 Jenrick et al. ..... 194/206
2002/0014736 A1 * 2/2002 Katou et al. ..... 271/126
2002/0053768 A1 * 5/2002 Blackwell et al. ..... 271/31.1

(Continued)

FOREIGN PATENT DOCUMENTS

CN 101783038 A 7/2010

OTHER PUBLICATIONS

Office Action dated Feb. 27, 2013 in Chinese Application No. 201110220779.4.

(Continued)

*Primary Examiner* — Jeffrey Shapiro
(74) *Attorney, Agent, or Firm* — Saliwanchik, Lloyd & Eisenschenk

(57) ABSTRACT

Provided is a financial device, which comprises a medium entrance, a medium processing apparatus, and a control unit. A medium is deposited or withdrawn through the medium entrance. The medium processing apparatus processes the medium. The control unit controls the medium processing apparatus. The medium processing apparatus comprises a front guider, a rear guider behind the front guider, a pushing member pushing a medium disposed in a medium processing space, and a supporting guider supporting the medium in the medium processing space. The control unit controls an operation of the medium processing apparatus such that states of the front guider, the rear guider, the pushing member, and the supporting guider when moving of a medium is completed in the medium processing space to deposit the medium are the same as states of the front guider, the rear guider, the pushing member, and the supporting guider when moving of a medium is completed in the medium processing space to withdraw or return the medium.

20 Claims, 14 Drawing Sheets

(56) References Cited

U.S. PATENT DOCUMENTS

| | | | | |
|---|---|---|---|---|
| 2003/0141651 | A1* | 7/2003 | Berdelle-Hilge et al. | 271/157 |
| 2004/0251110 | A1* | 12/2004 | Jenrick et al. | 194/207 |
| 2010/0059417 | A1 | 3/2010 | Lee et al. | |
| 2010/0163366 | A1* | 7/2010 | Jenrick et al. | 194/206 |

OTHER PUBLICATIONS

Chinese Patent Certificate dated Dec. 4, 2013 in Chinese Application No. 102346943.

* cited by examiner

FINANCIAL DEVICE, METHOD OF CONTROLLING THE SAME, AND MEDIUM PROCESSING APPARATUS

CROSS-REFERENCE TO RELATED APPLICATIONS

This application claims the benefit under 35 U.S.C. §119 of Korean Patent Application No. 10-2010-0074830, filed on Aug. 3, 2010, which is hereby incorporated by reference in its entirety.

BACKGROUND

Embodiments relate to a medium processing apparatus, a financial device, and a method of controlling the financial device.

Generally, financial devices are devices that process a financial transaction a customer desires. The financial devices deposit/withdraw a medium or automatically transfer the medium. The financial devices may comprise a medium processing apparatus for depositing and withdrawing a medium.

The medium processing apparatus comprises a plurality of guiders and a plurality of transfer rollers.

The positions of the guiders when depositing a medium, the positions of the guiders when withdrawing a medium, and the positions of the guiders when returning a medium are different from one another. Thus, to re-deposit a returned medium or a medium that is not taken out by a customer, the medium should be taken out from the medium processing apparatus, and input again.

BRIEF SUMMARY

Embodiments provide a financial device, method of controlling the same and a medium processing apparatus.

In one embodiment, a financial device comprises: a medium entrance through which a medium is deposited or withdrawn; a medium processing apparatus configured to process the medium; and a control unit configured to control the medium processing apparatus, wherein the medium processing apparatus comprises a front guider, a rear guider behind the front guider, a pushing member pushing a medium disposed in a medium processing space, and a supporting guider supporting the medium in the medium processing space, and the control unit controls an operation of the medium processing apparatus such that states of the front guider, the rear guider, the pushing member, and the supporting guider when moving of a medium is completed in the medium processing space to deposit the medium are the same as states of the front guider, the rear guider, the pushing member, and the supporting guider when moving of a medium is completed in the medium processing space to withdraw or return the medium.

In another embodiment, a medium processing apparatus comprises: a front guider; a rear guider behind the front guider; a pushing member pushing a medium disposed in a medium processing space; and a supporting guider configured to support the medium in the medium processing space, wherein disposition of the front guider, the rear guider, the pushing member, and the supporting guider when moving of a medium is completed in the medium processing space to deposit the medium is the same as disposition of the front guider, the rear guider, the pushing member, and the supporting guider when moving of a medium is completed in the medium processing space to withdraw or return the medium.

In another embodiment, a method of controlling a financial device comprises: discharging a medium to a space between a supporting guider and a rear guider to withdraw or return the medium; moving a pushing member downward to perform an interference prevention operation; pushing the medium forward by the rear guider; pushing the medium by the pushing member after moving the pushing member to a rear side of the medium and moving the pushing member upward; and moving the rear guider to a rear side of the pushing member.

The details of one or more embodiments are set forth in the accompanying drawings and the description below. Other features will be apparent from the description and drawings, and from the claims.

DETAILED DESCRIPTION

Figure 1:
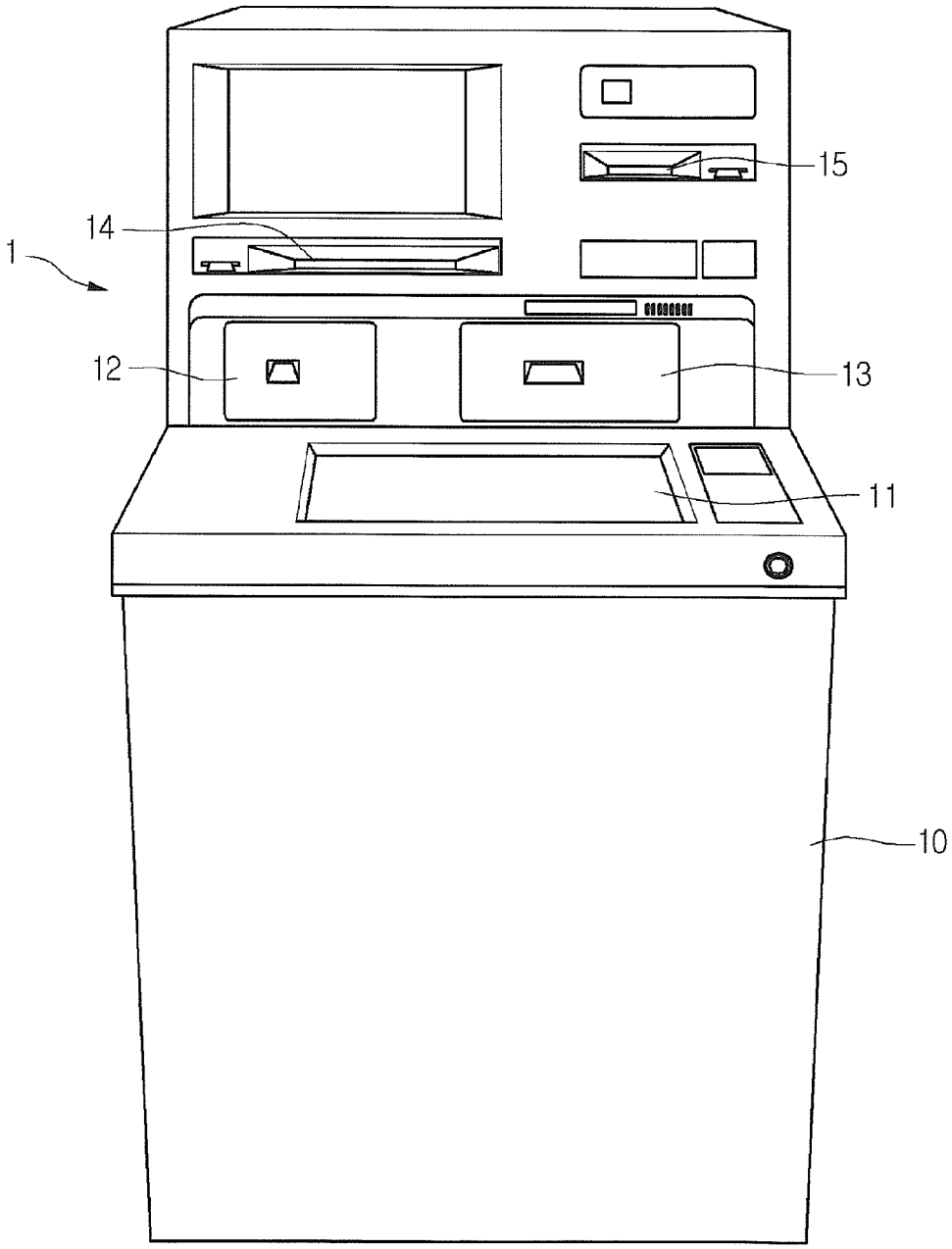
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected", "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various medium such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view illustrating a financial device according to an embodiment.

Referring to FIG. 1, a financial device 1 comprises a main body 10 that accommodates a number of parts. The main body 10 may comprise an input part 11 for a user to perform a financial process, a check entrance 12 through which a check is deposited and withdrawn, a paper money entrance 13 through which a paper money is deposited and withdrawn, a bankbook entrance 14 through which a bankbook is input and output, and a card entrance 15 through which a card is input and output. At least one of the check entrance 12, the bankbook entrance 14, and the card entrance 15 may be removed.

Since the financial device 1 may have a well-known structure, a description thereof will be omitted. The check entrance 12 and the paper money entrance 13 are referred to as a medium entrance herein.

Figure 2:
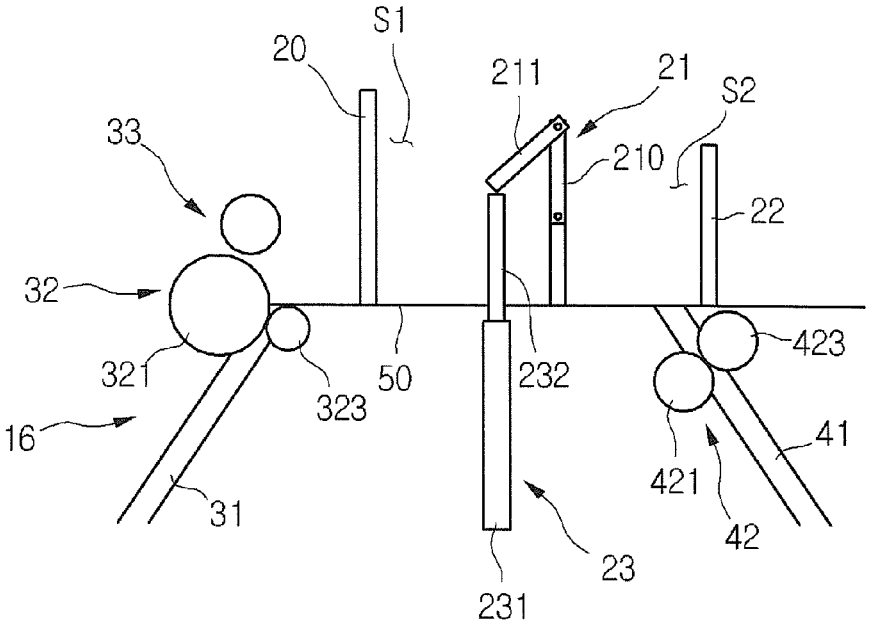
FIG. 2 is a schematic view illustrating a medium processing apparatus according to an embodiment.

FIG. 2 is a schematic view illustrating a medium processing apparatus according to an embodiment.

Referring to FIG. 2, a medium processing apparatus 16 processes a deposited medium or a medium to be withdrawn.

The medium processing apparatus 16 may comprise a front guider 20, a rear guider 22, a supporting guider 21 for supporting a medium to be withdrawn or a rejected medium, a pushing member 23 for pushing a medium to be deposited, and a supporting surface 50 for supporting a medium.

The medium processing apparatus 16 may comprise: a first passage 31 through which a medium to be deposited is transferred; a second passage 41 through which a medium to be withdrawn or rejected is transferred; a guide roller 33 for separating two or more media disposed in a first space S1 accommodating a medium to be deposited; a first roller unit 32 for transferring a medium to the first passage 31; and a second roller unit 42 for transferring a medium to be withdrawn or returned, from the second passage 41 to a second space S2. An overall operation of the medium processing apparatus 16 is controlled by a control unit (not shown). The first and second spaces S1 and S2 may be referred to as a medium processing space in the current embodiment.

Herein, a back-and-forth direction denotes the back and forth direction of the financial device 1. The first passage 31 is disposed in front of the second passage 41. The first space S1 is a space in which a medium initially input in the financial device 1 is disposed. The second space S2 is a space in which a medium discharged from the second passage 41 is disposed.

In detail, the front guider 20, the supporting guider 21, the rear guider 22, and the pushing member 23 may be moved in the back and forth direction by separate moving members, respectively. Examples of the moving members may comprise a motor that may transmit power through a transmission part such as a belt to an object to be moved, that is, to one of the front guider 20, the supporting guider 21, the rear guider 22, and the pushing member 23. However, the moving members are not limited thereto. While moving, the front guider 20, the supporting guider 21, the rear guider 22, and the pushing member 23 do not interfere with one another.

The supporting guider 21 comprises a supporting portion 210 and an input guide portion 211. The supporting portion 210 is substantially perpendicular to the supporting surface 50. The input guide portion 211 is inclined downward from the upper end of the supporting portion 210 toward the front guider 20. The input guide portion 211 may be rotatably coupled to the supporting portion 210. When a medium is transferred forward, the medium can rotate the supporting portion 210 upward. When the supporting portion 210 rotates upward, the input guide portion 211 can rotate upward together with the supporting portion 210. That is, the supporting guider 21 may rotate upward not to interfere with moving of the medium and other guiders.

The pushing member 23 may move back and forth to push a medium, and may move up and down not to interfere with a back and forth movement of a medium and other guiders. The pushing member 23 comprises a back-and-forth moving portion 231 and an up-and-down moving portion 232 that can move up and down and that is coupled to the back-and-forth moving portion 231. For example, the up-and-down moving portion 232 may be inserted in the back-and-forth moving portion 231. Alternatively, the back-and-forth moving portion 231 may be inserted in the up-and-down moving portion 232.

The first roller unit 32 may comprise a pair of rollers 321 and 323. The second roller unit 42 may comprise a pair of rollers 421 and 423. Thus, a medium passes through the space between the rollers 321 and 323, and the space between the rollers 421 and 423.

Deposit, withdrawal, and return of a medium will now be described.

Figure 3:
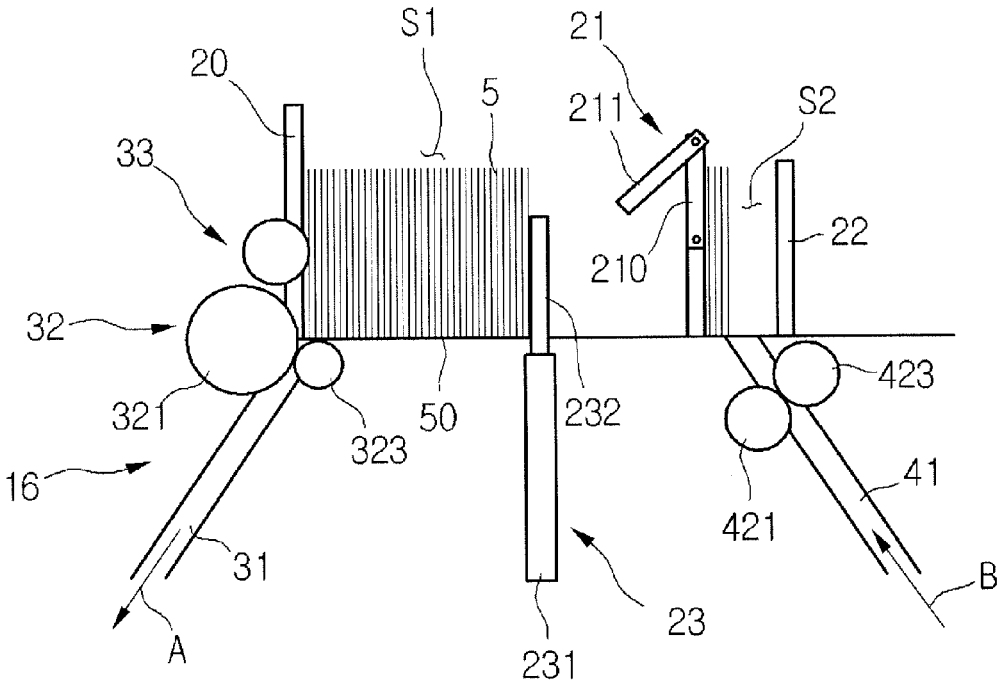
FIG. 3 is a schematic view illustrating a process of depositing media and a process of rejecting media according to an embodiment.

FIG. 3 is a schematic view illustrating a process of depositing media and a process of rejecting media according to an embodiment.

Herein, the term 'reject' denotes to discharge a deposited and separated medium through the second passage 41, and the term 'return' denotes to place a rejected medium at a position in which a customer can receive the medium.

Referring to FIGS. 2 and 3, a medium introduced through a medium entrance is disposed in the first space S1. The medium may be guided by the input guide portion 211. When the medium is deposited, the front guider 20, the pushing member 23, the supporting guider 21, and the rear guider 22 are sequentially arrayed from the front side to the rear side.

In this state, the pushing member 23 moves forward to push the medium as illustrated in FIG. 3. The front guider 20 and the pushing member 23 move forward to separate introduced media 5. Then, the guide roller 33 rotates to separate at least two of the media 5 and move the media 5 downward. The first roller unit 32 rotates to transfer the separated media 5 along the first passage 31 (refer to an arrow A).

When a recognition error occurs during deposit of a medium, or a damaged medium is deposited, the medium is rejected through a certain path and the second passage 41 to the second space S2 between the supporting guider 21 and the rear guider 22 (refer to an arrow B). Return of the rejected medium will be described later.

FIGS. 4 to 8 are schematic views illustrating withdrawal of media according to an embodiment.

Figure 4:
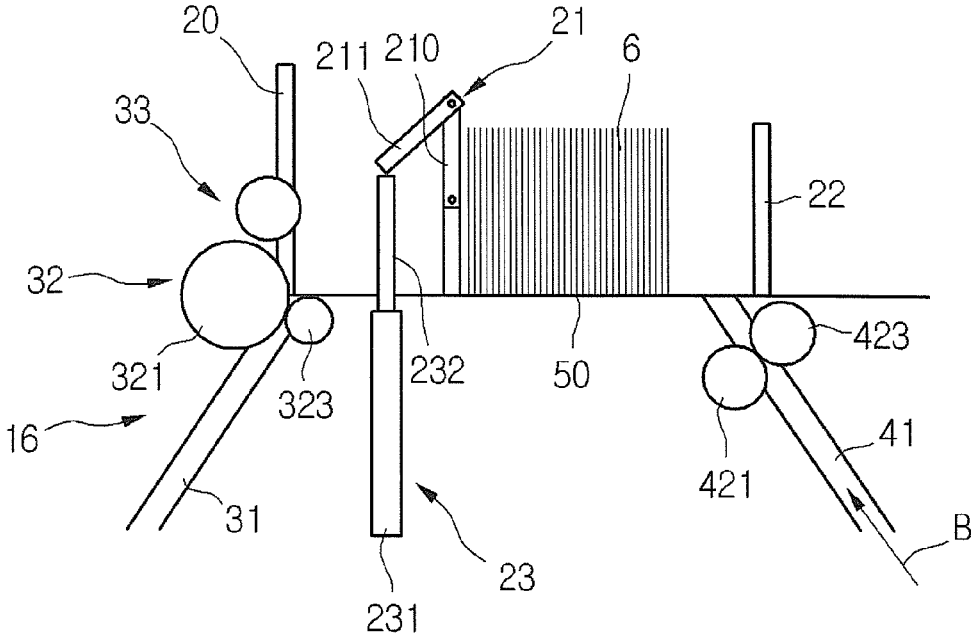
FIGS. 4 to 8 are schematic views illustrating withdrawal of media according to an embodiment.

Referring to FIG. 4, when a customer performs a process to withdraw a certain amount of media 6, the media 6 is transferred through the second passage 41, and is disposed between the supporting guider 21 and the rear guider 22 (refer to the arrow B). Initially, the up-and-down moving portion 232 is disposed between the front guider 20 and the supporting guider 21.

Figure 5:
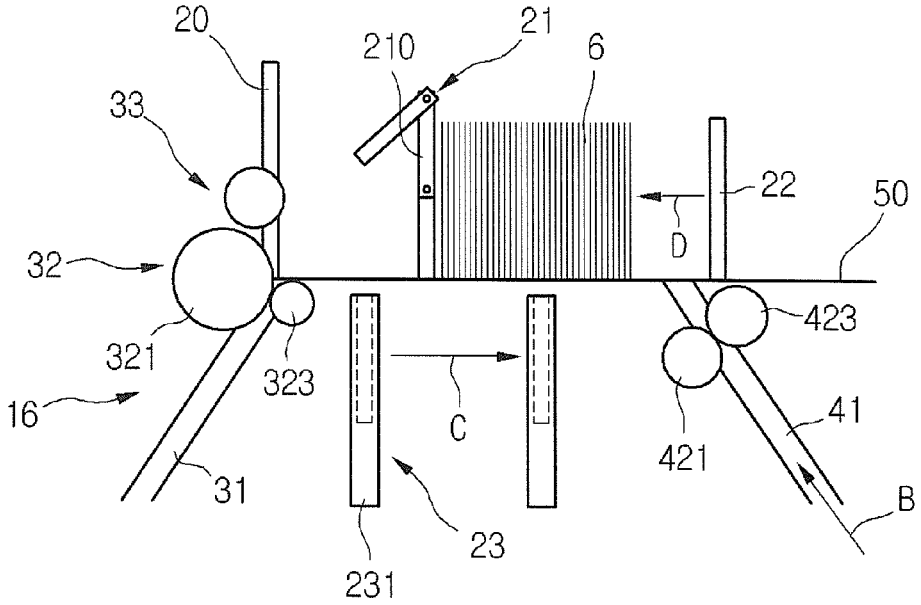
Figure 6:
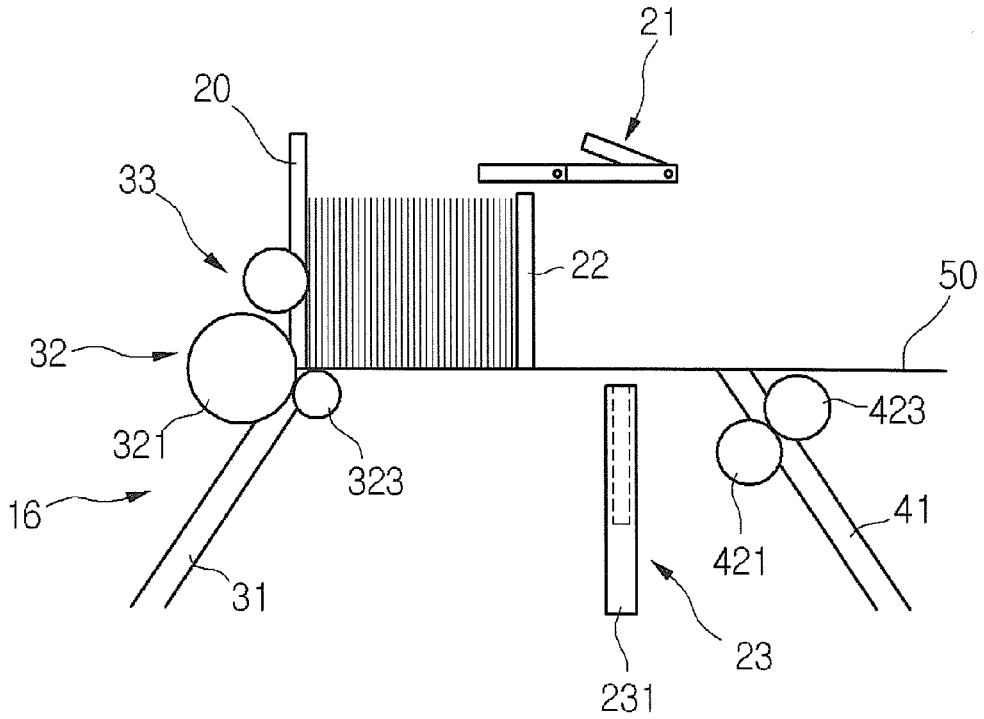

In this state, referring to FIG. 5, the up-and-down moving portion 232 moves downward, and is inserted into the back-and-forth moving portion 231. Then, the pushing member 23 moves rearward (refer to an arrow C). The rear guider 22 moves forward (refer to an arrow D). When the rear guider 22 moves forward, the media 6 move forward to the front guider 20. While the rear guider 22 moves forward, the supporting guider 21 rotates upward as illustrated in FIG. 6, not to interfere with the supporting guider 21 and the rear guider 22. When the rear guider 22 completely moves forward, the rear guider 22 is disposed in front of the pushing member 23.

Figure 7:
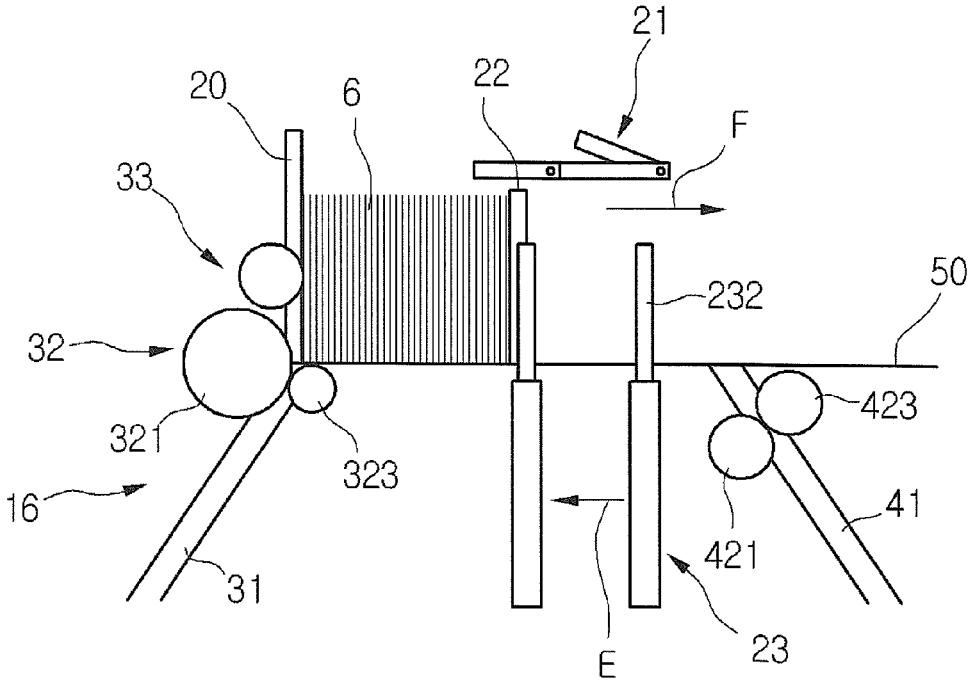
Figure 8:
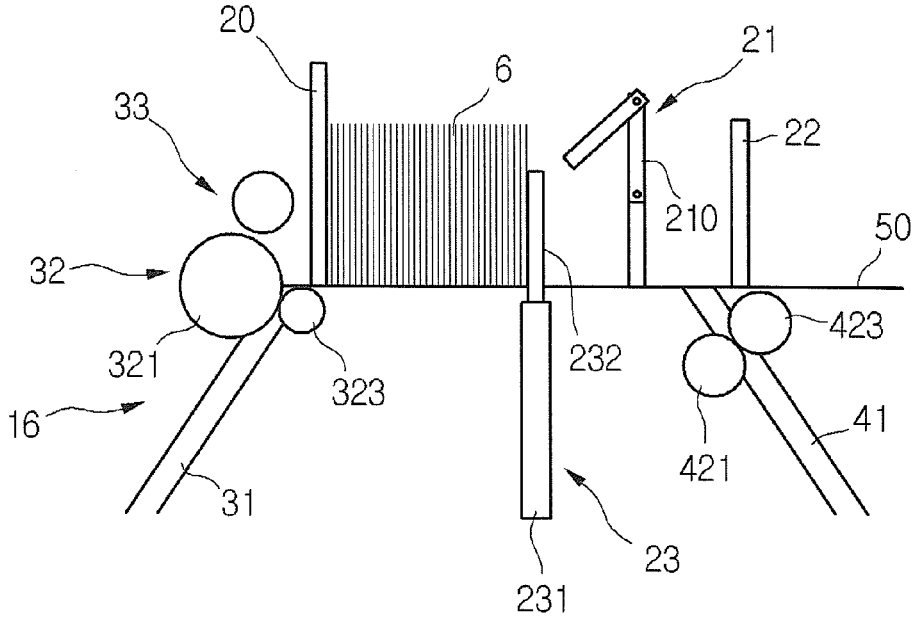

Then, referring to FIG. 7, the up-and-down moving portion 232 moves upward from the back-and-forth moving portion 231. Then, the up-and-down moving portion 232 is disposed behind the rear guider 22. Then, the pushing member 23 moves forward (refer to an arrow E) to overlap the rear guider 22.

In this state, the rear guider 22 moves rearward (refer to an arrow F). That is, after the pushing member 23 overlaps the rear guider 22, the rear guider 22 moves rearward without interfering with the pushing member 23. In this state, the pushing member 23 supports the media 6.

Then, the supporting guider 21 returns to its original state (unfolded state). Then, the media 6 is disposed between the front guider 20 and the up-and-down moving portion 232. Finally, the medium entrance is opened, so that the customer can withdraw the media 6.

The positions of the front guider 20, the supporting guider 21, the rear guider 22, and the pushing member 23 when a medium is withdrawn are the same as the positions of the front guider 20, the supporting guider 21, the rear guider 22, and the pushing member 23 when a medium is deposited.

Return of rejected media will now be described.

Figure 9:
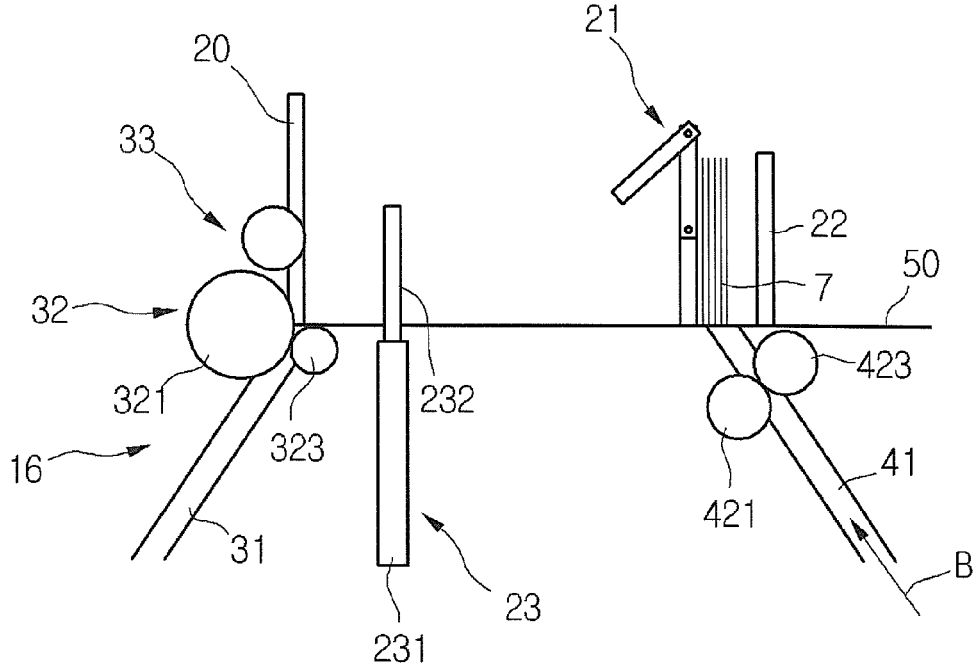
FIGS. 9 to 10 are schematic views illustrating reject and return of media according to an embodiment.
Figure 10:
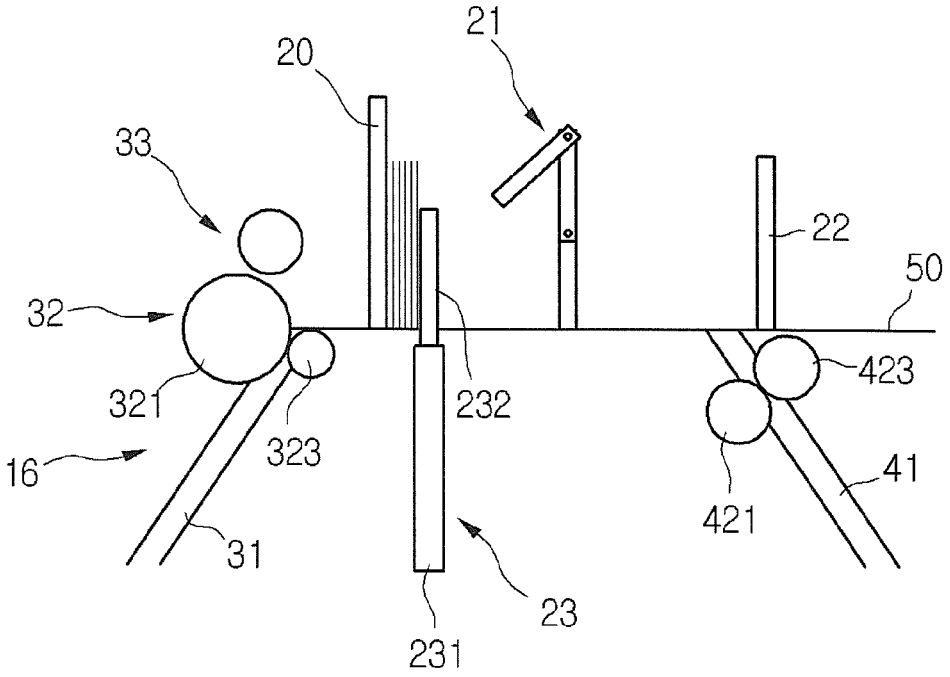

FIGS. 9 to 10 are schematic views illustrating reject and return of media according to an embodiment.

Referring to FIG. 9, media may be rejected, like the case of FIG. 3. The rejected medium may be a medium that cannot be recognized, or a medium that is placed in a temporary stacking portion (not shown) after deposit and separation. The media placed in the temporary stacking portion can be rejected when the deposit is cancelled. Media 7 are rejected in the direction of the arrow B. Then, the media 7 are disposed in the second space S2 between the supporting guider 21 and the rear guider 22.

In this state, the medium processing apparatus performs the processes as illustrated FIGS. 5 to 8, and becomes a state as illustrated in FIG. 10. That is, the media 7 is disposed between the front guider 20 and the up-and-down moving portion 232. In this state, a customer can take out the media 7.

Figure 11:
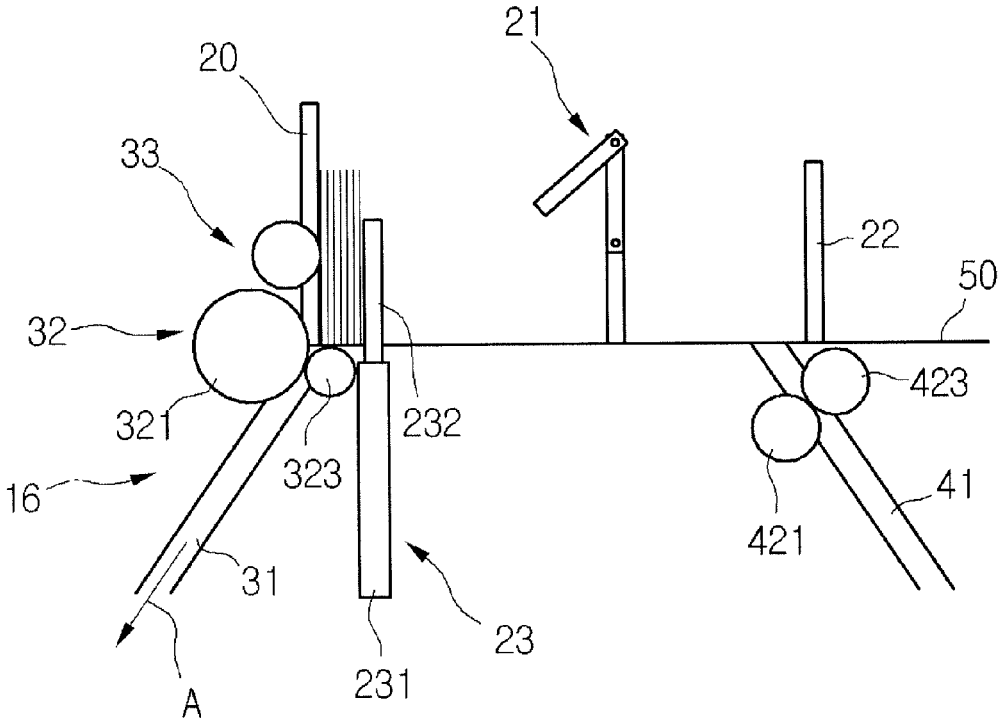
FIG. 11 is a schematic view illustrating re-deposit of media when being returned and not taken out, according to an embodiment.

FIG. 11 is a schematic view illustrating re-deposit of media when being returned and not taken out, according to an embodiment.

Referring to FIG. 11, when returned media are not taken out by a customer in the state of FIG. 10, the front guider 20 and the pushing member 23 move forward, and the returned media are re-deposited through the process as illustrated in FIG. 3.

Figure 12:
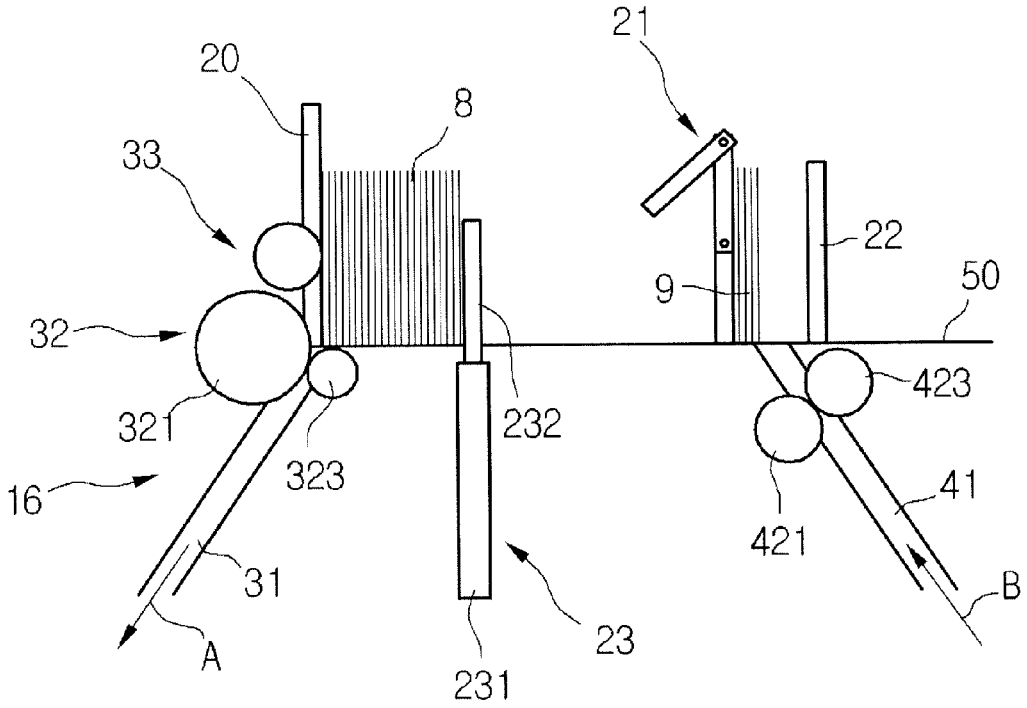
FIGS. 12 to 14 are schematic views illustrating return of media while being deposited and separated, according to an embodiment.
Figure 13:
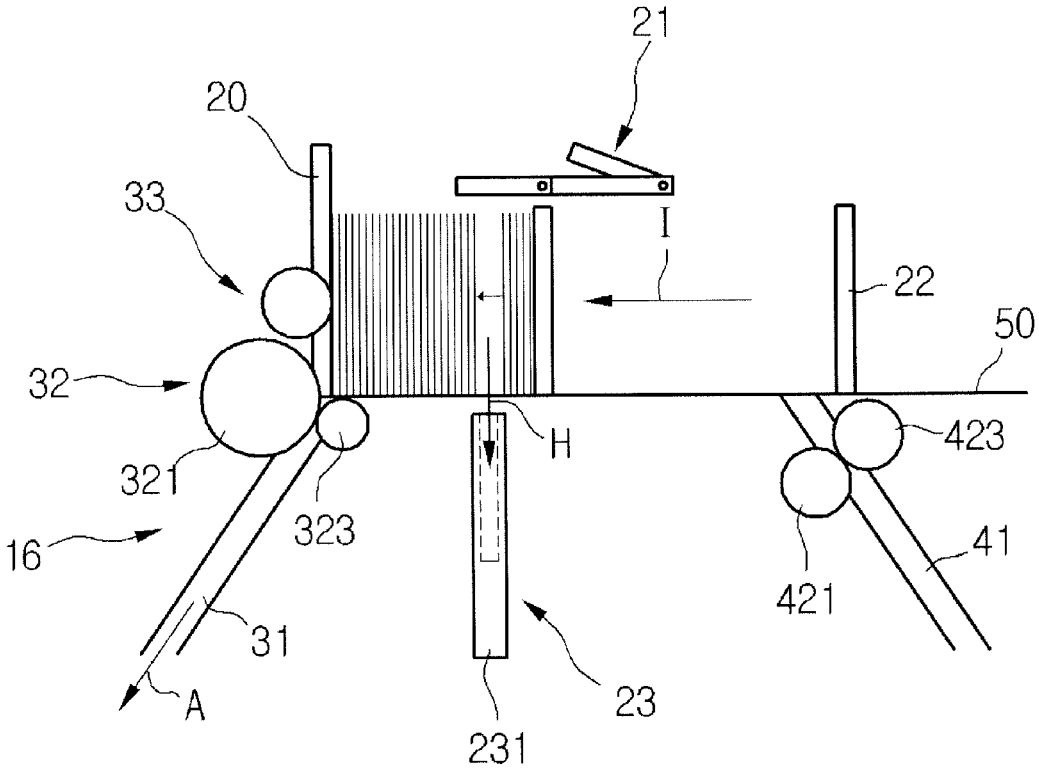
Figure 14:
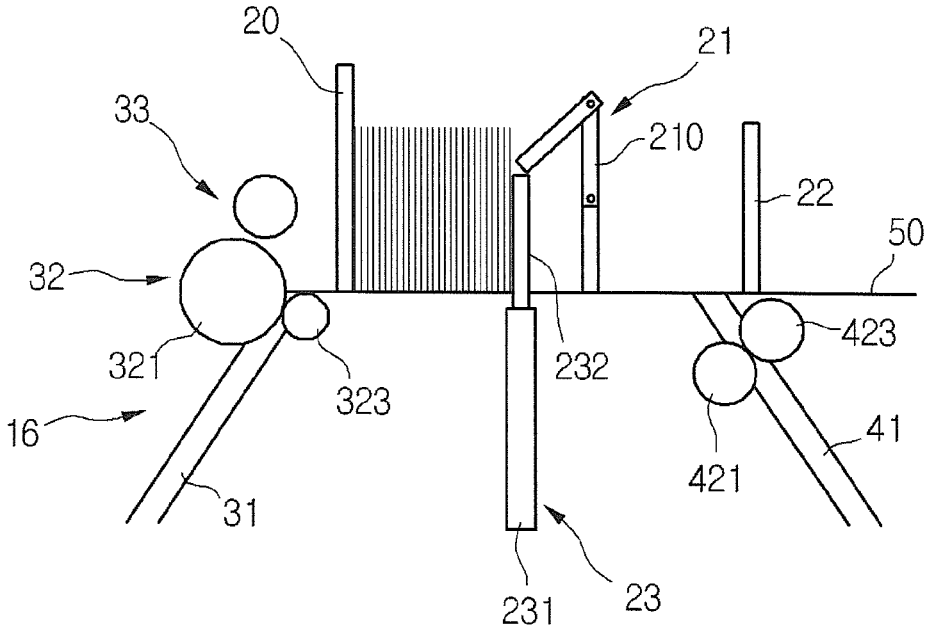

FIGS. 12 to 14 are schematic views illustrating return of media while being deposited and separated, according to an embodiment.

Referring to FIG. 12, media 9 may be rejected while media 8 are deposited and separated, like the case of FIG. 3. For example, when a financial device is in an abnormal state while media are deposited and separated, when deposit of media is cancelled by a customer, or when an error occurs during a deposit and separation process, the media may be rejected. Referring to FIG. 13, the up-and-down moving portion 232 moves downward (refer to an arrow H), and is inserted into the back-and-forth moving portion 231, and the rear guider 22 moves forward (refer to an arrow I). While the rear guider 22 moves forward, the supporting guider 21 is rotated upward by the media 9, which is the same as the process of FIG. 6.

Then, the rejected media 9 are added to the media 8 to be deposited and separated. Then, the pushing member 23 and the rear guider 22 perform the processes as illustrated FIGS. 7 and 8, and the medium processing apparatus finally becomes a state as illustrated in FIG. 14. In this state, a customer can take out media to be deposited. Alternatively, returned media can be re-deposited according to a customer's need.

According to the embodiments, the states (disposition) of the guiders and the pushing member when moving of media is completed in the medium processing space to withdraw and return the media are the same as the states (disposition) of the guiders and the pushing member when moving of media is completed in the medium processing space to deposit the media. Therefore, a medium can be re-deposited without taking out the medium and then re-inputting the medium.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A financial device comprising:

a medium entrance in a surface of the financial device through which a medium is deposited in a deposit action and through which a medium is withdrawn or returned in a withdrawal or return action;

a medium processing apparatus of the financial device configured to process the medium:

and a control unit of the financial device configured to control the medium processing apparatus;

wherein the medium processing apparatus comprises a from guider, a rear guider behind the front guider, a medium processing space between the front guider and the rear guider, a pushing member and a supporting guider both disposed in the medium processing space, the front guider, the rear guider, the pushing member, and the supporting guider all being movable in the medium processing space; and wherein the supporting guider and the rear guider are configured such that, in a withdrawal or return action a medium is discharged to a space between them and is supported by the supporting guider for withdrawing or returning, the pushing member is configured to move to perform an interference prevention operation such that the pushing member does not inhibit movement of the rear guider, the rear guider is configured to move to push the medium toward the front guider while the pushing member performs the interference prevention operation, the pushing member and the rear guider are configured such that the pushing member supports the medium after the pushing member moves to a rear side of the medium pushed forward by the rear guider, the rear guider is configured to move to a rear side of the pushing member after the pushing member supports the medium such that the rear guider moves to a position behind the front guider to restore the same medium processing space between the front guider and the rear guider;

wherein the control unit controls an operation of the medium processing apparatus such that the relative states of disposition of the front guider, the rear guider, the pushing member, and the supporting guider upon the condition that a medium is moved to a position in the medium processing space for a deposit action are the same as the relative states of disposition of the front guider, the rear guider, the pushing member, and the supporting guider upon the condition that a medium is moved to a position in the medium processing space for a withdrawal or return action.

2. The financial device of claim 1, wherein the pushing member moves back and forth to push a medium, and moves up and down to prevent an interference with a back-and-forth movement of the other guiders and a medium.

3. The financial device of claim 2, wherein the pushing member comprises:

a back-and-forth moving portion that is allowed to move back and forth; and an up-and-down moving portion that is connected to the back-and-forth moving portion and is allowed to move up and down.

4. The financial device of claim 1, wherein the supporting guider comprises:

a supporting portion for supporting a medium, and an input guide portion obliquely extending from the supporting portion to guide a medium that is input.

5. The financial device of claim 4, wherein the input guide portion and the supporting portion are rotatably connected to each other, and rotate together to prevent an interference with a back-and-forth movement of the other guiders, the push member and the medium.

6. The financial device of claim 5, wherein the supporting portion rotates upward when the medium in contact with the supporting portion is pushed forward by forward motion of the rear guide pushing the medium.

7. The financial device of claim 1, wherein, when a medium is deposited, the medium is disposed between the front guider and the pushing member, the supporting guider is disposed behind the pushing, member, and the rear guider is disposed behind the supporting guider.

8. The financial device of claim 1, wherein, when a medium to be withdrawn or returned is discharged to a space between the supporting guider and the rear guider, the pushing member moves downward, and the rear guider pushes the medium forward.

9. The financial device of claim 8, wherein, after the rear guider pushes the medium forward, the pushing member disposed behind the medium pushes the medium, and the rear guider moves to a rear side of the pushing member.

10. A medium processing apparatus in a financial device comprising:

a front guider;

a rear guider behind the front guider;

a pushing member and a supporting guider both disposed in a medium processing space between the front guider and the rear guider in the financial device; wherein the front guider, the rear guider, the pushing member, and the supporting are all movable;

a first passage through which a medium introduced in the medium processing space for a deposit action is transferred; and a second passage through which a medium to be withdrawn or rejected is transferred;

wherein the relative disposition of the front guider, the rear guider, the pushing member, and the supporting guider when a medium for depositing is introduced in the medium processing space for a deposit action is the same as the relative disposition of the front guider, the rear guider, the pushing member, and the supporting guider when moving of a medium for a withdrawal or return action is completed in the medium processing space; and wherein when a medium is introduced into the medium processing space for a deposit action it is located in the same relative space as is a medium to be withdrawn or returned when moving of the medium to be withdrawn or returned s completed in the medium processing space, wherein the medium to be withdrawn or rejected is transferred to the medium processing space via the second passage and then re-deposited via the first passage.

11. The medium processing apparatus of claim 10, wherein the pushing member moves back and forth to push a medium, and moves up and down to prevent art interference with a back-and-forth movement of the other guiders and a medium.

12. The medium processing apparatus of claim 11, wherein the pushing member comprises:

a back-and-forth moving portion that is allowed to move back and forth; and an up-and-down moving portion that is connected to the back-and-forth moving portion and is allowed to move up and down.

13. The medium processing apparatus of claim 10, wherein the supporting guider comprises:

a supporting portion for supporting a medium, and an input guide portion obliquely extending from the supporting portion to guide input of a medium.

14. The medium processing apparatus of claim 13, wherein the input guide portion and the supporting portion are rotatably connected to each other, and rotate together to prevent an interference with a back-and-forth movement of the other guiders, the pushing, member and the medium.

15. A method of controlling a financial device, the method comprising:

discharging a medium to a space between a supporting guider and a rear guider to withdraw or return the medium;

moving a pushing member downward to perform an interference prevention operation;

pushing, the medium forward by the rear guider while the interference prevention operation is being performed;

pushing the medium by the pushing member after moving the pushing member to a rear side of the medium pushed forward by the rear guider and moving the pushing member upward; and moving the rear guider to a rear side of the pushing member after moving the pushing member upward.

16. The method of claim 15, wherein the supporting guider comprises a supporting portion for supporting a medium, and an input guide portion obliquely extending from the supporting portion to guide input of a medium, and the pushing of the medium forward by the rear guider rotates the supporting portion.

17. The method of claim 15, further comprising re-depositing the discharged medium.

18. The method of claim 15, further comprising depositing a medium, wherein, when the depositing of the medium is stopped or completed, the medium is discharged to the space between the supporting guider and the rear guider.

19. The method of claim 18, wherein the medium discharged to the space between the supporting guider and the rear guider comprises at least one of a medium discharged by a cancel operation and a medium discharged by a recognition error.

20. The apparatus of claim 1, wherein the withdrawn or returned medium is re-deposited without taking out the withdrawn or returned medium from the medium processing space, and wherein the front guider, the rear guider, the pushing member, and the supporting guider are separately movable, the rear guider being movable from a position behind the pushing member to a position in front of the pushing member.

* * * * *